US006046724A

United States Patent [19]

Hvass

[11] Patent Number: 6,046,724

[45] Date of Patent: Apr. 4, 2000

[54] METHOD AND APPARATUS FOR CONVERSION OF SOUND SIGNALS INTO LIGHT

[76] Inventor: Claus Hvass, Kirkegårdsgade 3, DK-9000 Aalborg, Denmark

[21] Appl. No.: 08/973,625

[22] PCT Filed: Jun. 7, 1996

[86] PCT No.: PCT/DK96/00248

§ 371 Date: Feb. 17, 1998

§ 102(e) Date: Feb. 17, 1998

[87] PCT Pub. No.: WO96/41667

PCT Pub. Date: Dec. 27, 1996

[30] Foreign Application Priority Data

Jun. 8, 1995 [DK] Denmark ..... 644/95

[51] Int. Cl.[7] ..... G09G 5/10

[52] U.S. Cl. ..... 345/150; 348/162; 348/163; 348/754; 340/815.46; 367/7

[58] Field of Search ..... 340/815.46, 815.65, 340/815.69; 348/162, 163, 185, 744, 754; 367/7, 8; 73/607; 345/150, 73

[56] References Cited

U.S. PATENT DOCUMENTS

| | | | |
|---|---|---|---|
| 5,191,319 | 3/1993 | Kiltz | 340/815.46 |
| 5,403,261 | 4/1995 | Shimizu et al. | 600/27 |
| 5,504,522 | 4/1996 | Setogawa | 348/185 |
| 5,659,173 | 8/1997 | Putterman et al. | 250/361 C |

*Primary Examiner*—Ba Huynh
*Attorney, Agent, or Firm*—Lee, Mann, Smith, McWilliams, Sweeney & Ohlson

[57] ABSTRACT

Method and apparatus for the conversion of sound waves to electromagnetic wave forms, preferably light, whereby sound waves are converted to an electrical signal and processed by a number of filters, the distribution between the filters being a result of the frequency of the sound wave and in which the filters are subsequently connected to their respective color display and where the individual color display's activation is directly proportional to their filter's amount of signal processing and where the color display visualization in a display means is in the form of a single color or a mixture of two or more color displays.

3 Claims, 9 Drawing Sheets

METHOD AND APPARATUS FOR CONVERSION OF SOUND SIGNALS INTO LIGHT

Figure 1:
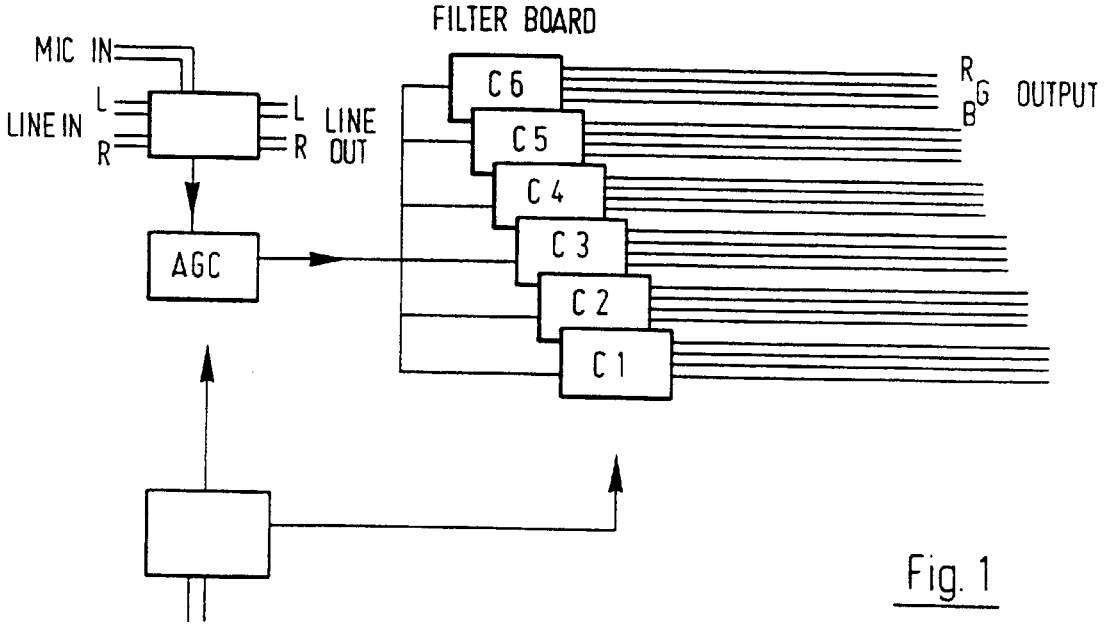

The invention concerns a method for the conversion of soundwaves into electromagnetic wave movement, preferably light, whereby soundwaves are converted to an electrical signal and are processed by a number of filters, and in addition an apparatus for performing the method.

U.S. Pat. No. 5,191,319 discloses a system for filtering music in 11 variable width frequency bands, in which every interval results in a preset colour display. In this patent the colours are chosen from what visually looks best.

U.S. Pat. No. 4,614,942 discloses a system as the above, but where a fourband model is used, in which one similarly chooses a colour visualisation based on sound influences based on what seems most visually appropriate. In other words, the state of the art shows converting of sound into light, but where a signal may only imply that one colour is activated, and thereby does not give the possibility for blending of colours, where the colour mixture will assume different appearances, depending on from which frequency the sound originates.

It is the purpose of the invention to create a method which does not have the disadvantages of the previous mentioned systems, and where it is possible to convert sound to light by means of colours in such a way that a specified frequency will represent a single colour or mixtures of colours.

This purpose is achieved by the method referred to in the introduction and where, in addition, one filter processes a part of the electrical signal, the size of which part being dependent of the frequency of the sound wave, and also that the remaining filters process the remaining part of the electrical signal, whose distribution among the remaining filters is similarly a function of the frequency of the sound wave, which filters subsequently each are connected to respective colour displays, where the colour display of each filter is a predetermined colour, and where the generating of each single colour display is directly proportional to the part of the signal processesing of the corresponding filter, which colour displays are visualized in a colour display means as a single colour or as a mixture of two or more colour displays.

By such a method it is possible to convert any sound to a light image, possibly on a computer screen or a light emission source. Depending on the tone, a sound will show itself as an image of an individual colour or combination of colours, in that a sound tone will result in a single or more filters being activated and where each filter is connected to colour displays. For example, if a filter is connected to a colour display that is blue, together with another filter colour display which is yellow and if the filters are activated in the ratio 1:1, the output on the display means will be green. It is thereby possible to achieve a infinitely variable, visual registration of a sound signal which can be used with sound shows, that are to be visualized, and in connection with deaf-handicapped who, by this process, can achieve an understanding and awareness of sound.

By using such a method according to the invention; it allows the possibility of mixing only two colours together with the individual chosen colour, which results in an unambiguous signal and reading/decoding of the sound. This is important especially in connection with the use of the invention by deaf-handicapped.

By using a method according to the invention an appropriate processing of sound which is easy to visualize is achieved.

By using a method according to the invention an appropriate means of visualizing the whole audible sound spectrum is achieved.

All colours may be expressed either as a frequency (Hertz) or as wavelengths (nanometers). This applies similarly to the audible sound areas, where wavelengths are expressed i m, cm, or mm. The human ear can detect sound from approx 20 Hz to approx 20 kHz (wave-lengths from 20 m to 20 mm) corresponding to 10 octaves. The human eye can register wavelengths from approx 792 nm to 396 nm, corresponding to one doubling of the frequency or 1 audible octave. The optimal display is therefore devided in 10 sections.

In order to visualize the complete audible sound spectrum there is need for 10 displays representing 10 succeeding frequency doublings. Each display represents the whole colour spectrum through the three primary colours red, green, and blue.

If we spectrally convert all the audible frequencies simultaneously (white noise) the result will be white light (equal parts of red, green, blue). Silence will be equivalent to darkness.

By the use of the method according to the invention the use of a specific and up to date displaying apparatus will be achieved.

By the use of the method as disclosed, it is possible to visually realize not only the individual tones, but also to show, in which interval the tone takes place, in other words whether the octave used belongs to low or high frequencies. This is especially useful for the deaf.

In order to achieve an optimal visualization of sound the colour display apparatus is constructed in such a way so that low frequencies are displayed at the bottom and high frequencies at the top. This makes it possible to see more frequencies at the same time, thus it is possible, for example, to see overtone spectra of individual sounds or several different sounds, voices and/or instruments at the same time.

The invention in addition relates to an apparatus for the effectuation of this process.

The human voice has a complex oscillisation structure, containing fundamental tones, overtones, vowels, consonants and formants, which will all be visible in several of the converters display and octave areas simultaneously.

Differences in human physique and psychology results in human voices sounding differently. This also means that different voices also are visualized differently even though they are singing the same note into the apparatus.

By means of the colour display apparatus the spectator can learn to see and also remember a specific colour combination expressing specific tone shades. In this way an auditive impression can be experienced together with visual impressions.

Figure 2:
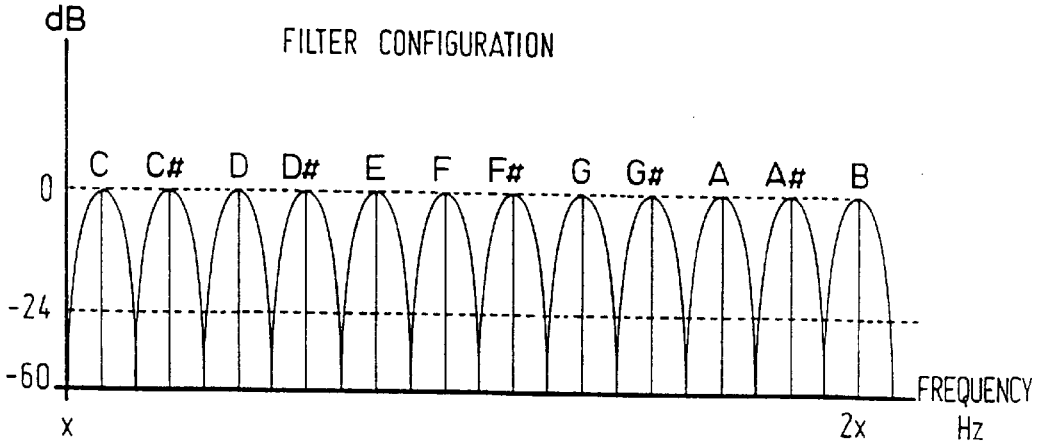
Figure 3:
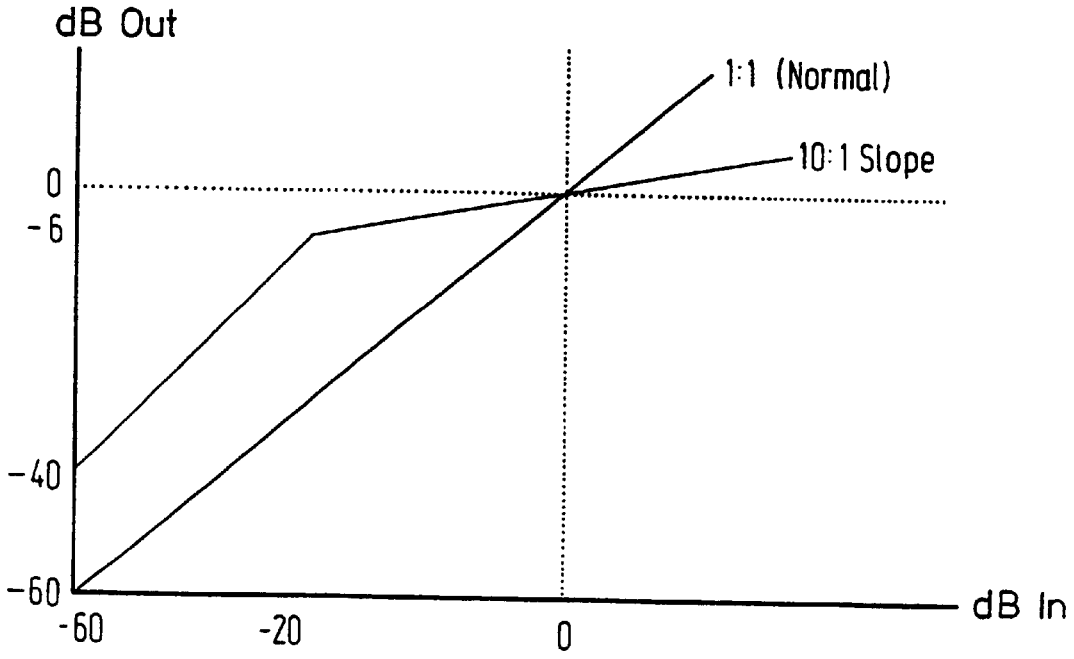
Figure 4:
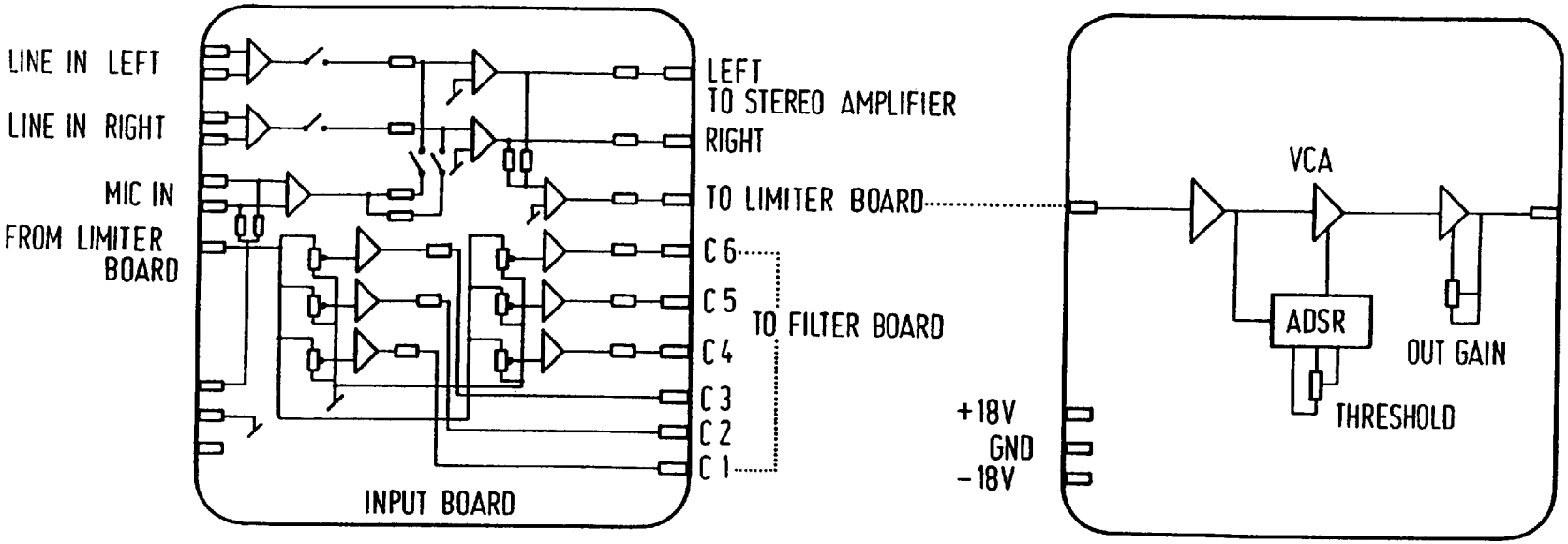
Figure 5:
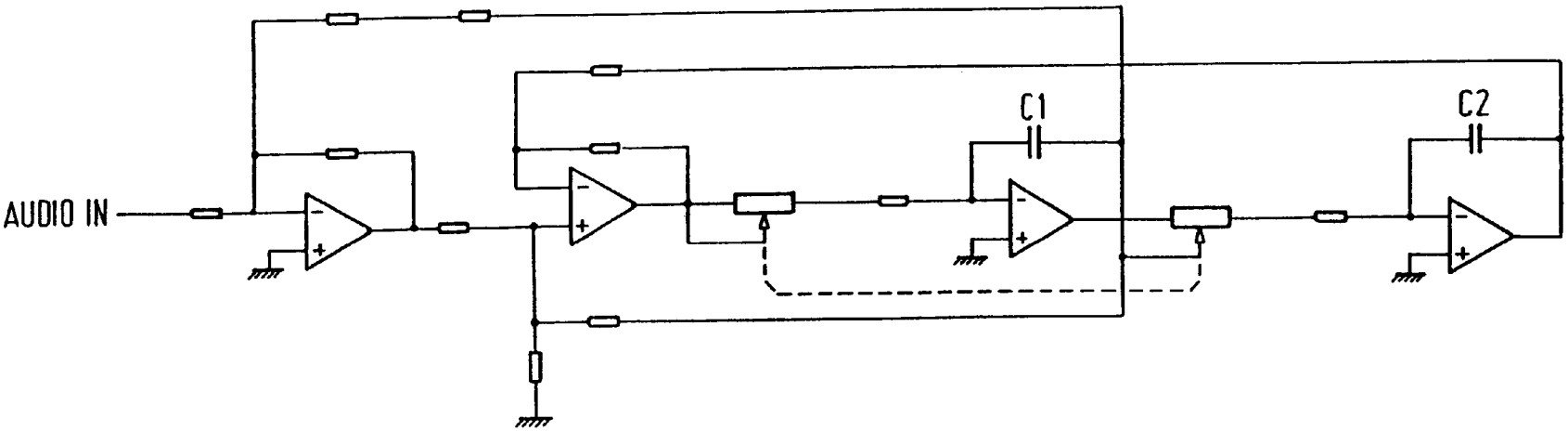
Figure 6:
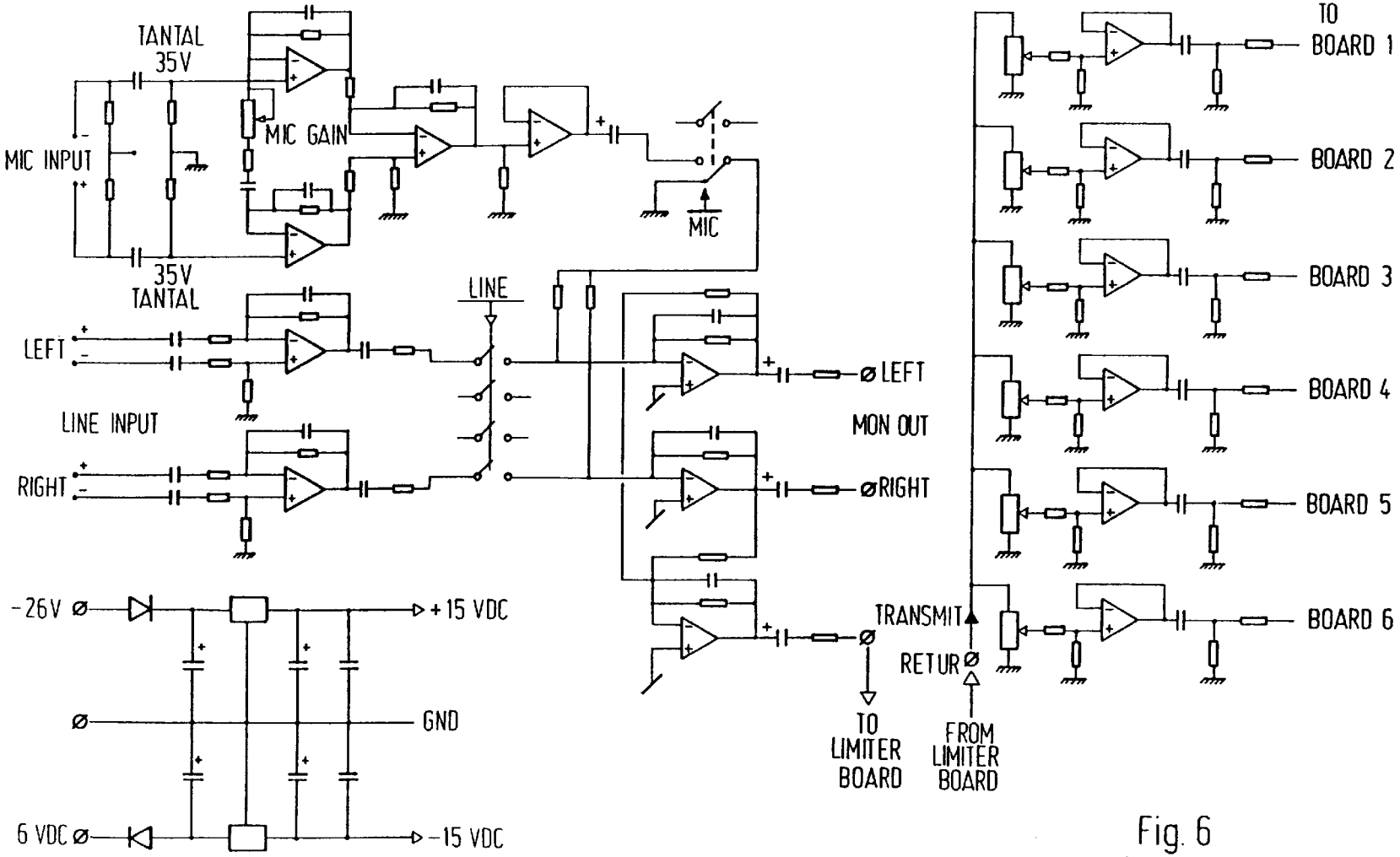
Figure 7:
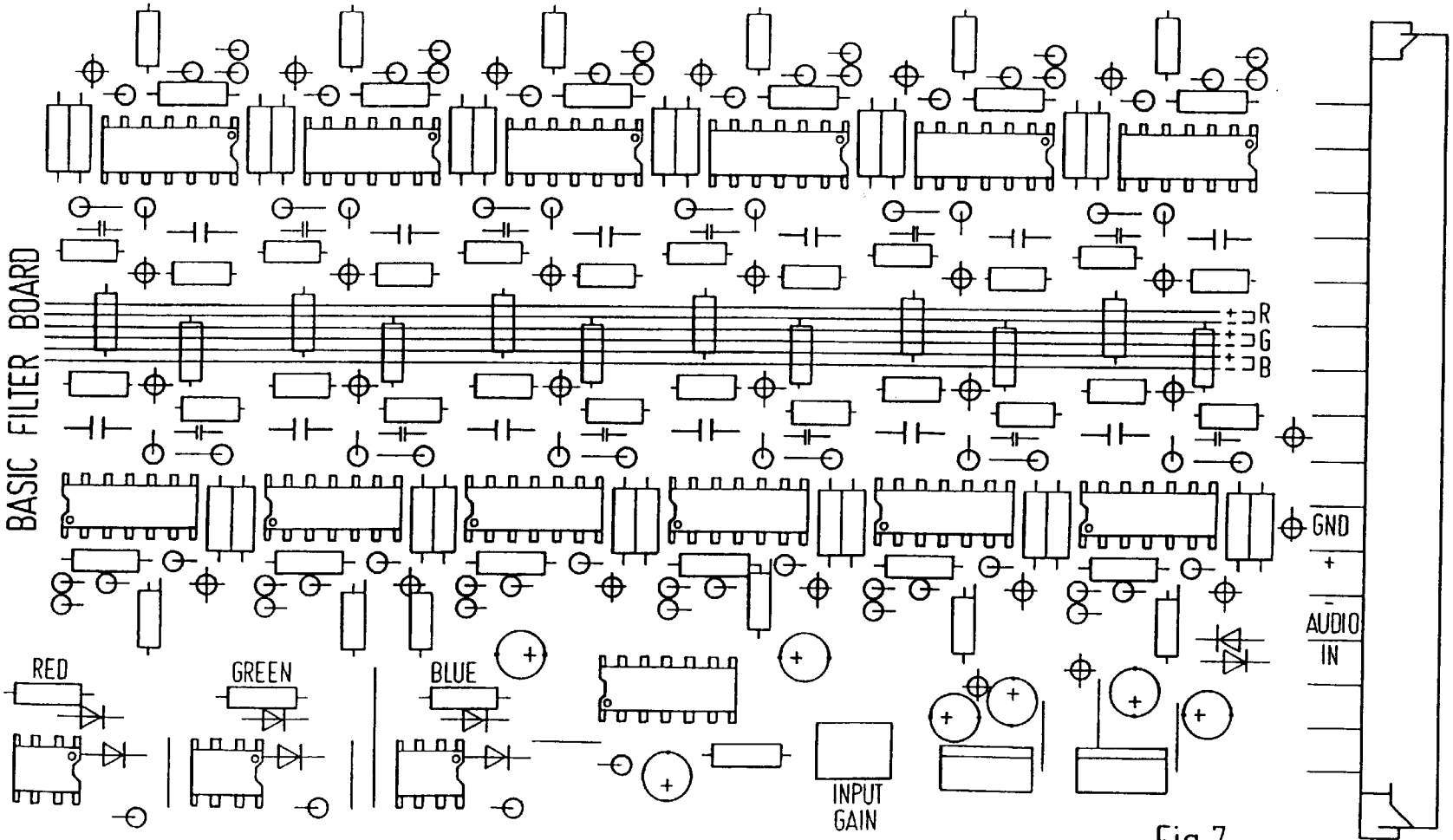
Figure 8:
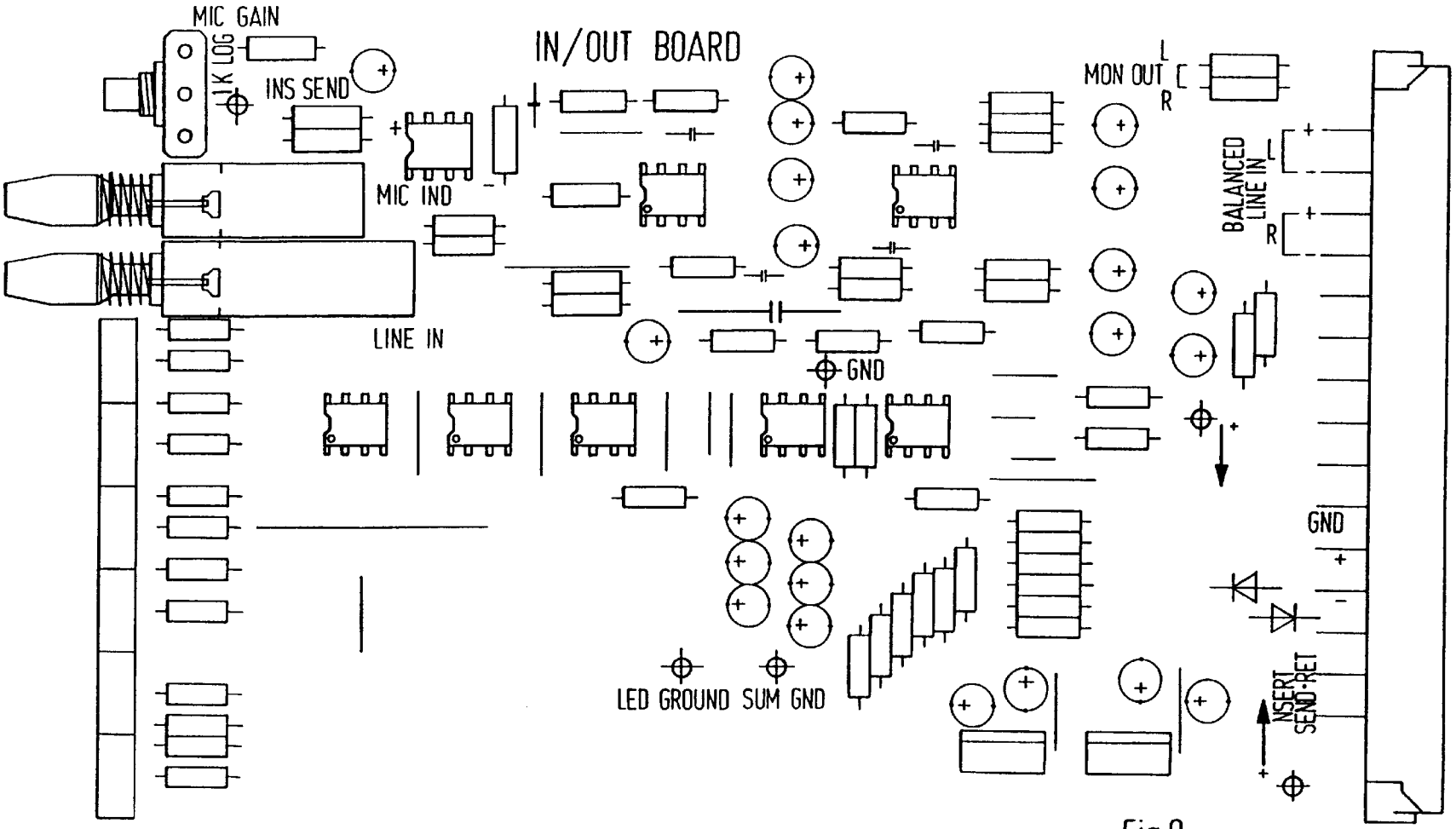
Figure 9:
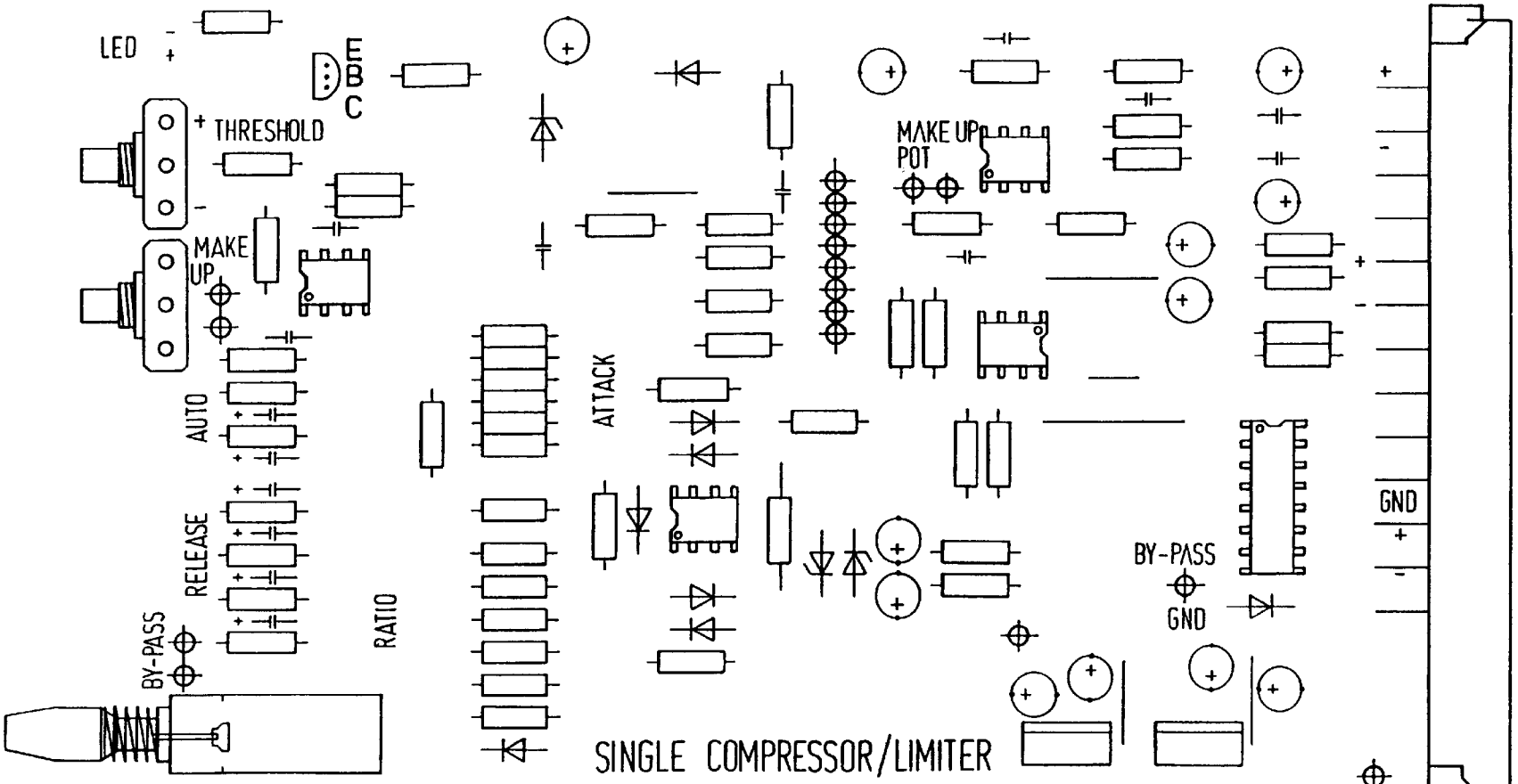
Figure 10:
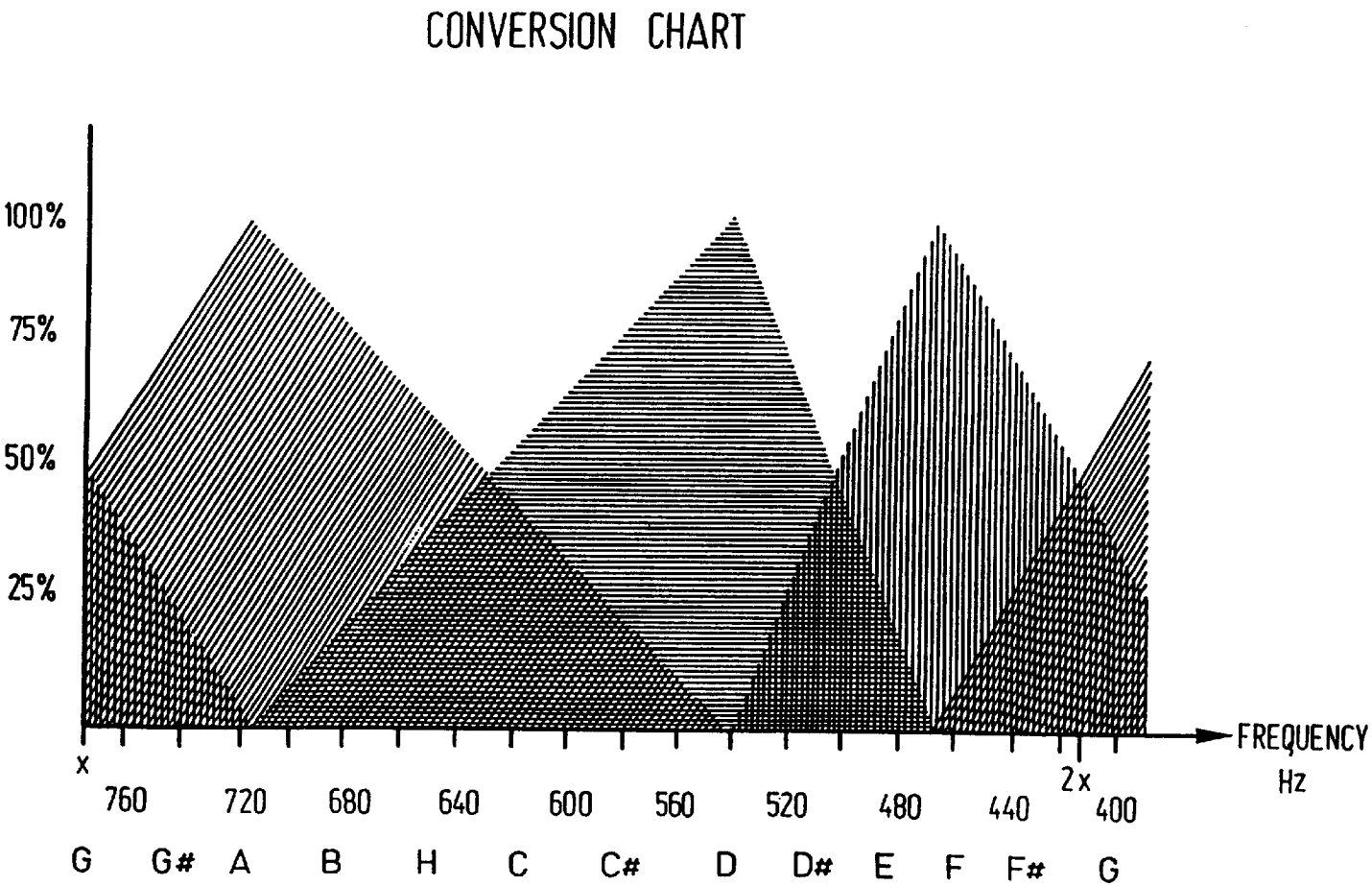

The invention will now be described in more detail with references to the drawings, where FIG. 1 the principal layout plan for the conversion, FIG. 2 illustrates a filter configuration for a prototype where a filter with a step characteristic has been chosen, FIG. 3 illustrates the limiter function for the conversion, FIG. 4 the signal path of the converter, FIG. 5 illustrates the state-variable filter, FIG. 6 illustrates the input board, FIG. 7 illustrates the basic filter board, FIG. 8 illustrates the in/out board, FIG. 9 illustrates the single compressor/limiter, FIG. 10 illustrates the conversion diagram and filter configuration for another prototype.

FIG. 1 illustrates the conversion possibilities for a sound, in which we have a filtercard able to analyse electrically presented sound sources. A light control component consisting of light dimmers with relevant light sources. Each filtercard is connected to 3 light dimmers with their respective 3 lightsources in the 3 primary colours. A display component consisting of transparent material (plastic, plexiglas, glass etc.) or alternatively a white surface upon which the three primary colours can be mixed or projected.

The conversion analysis component contains a number of filter cards. Each filter card comprises 3 filters and each card has 3 outputs—one for each primary colour. Outputs are suitable for controlling standard light dimmers with control voltage 0–10 VDC. When the filter card is activated by an electrically presented sound signal, the filter analyses the frequency and dynamics. By way of the card's conversion factor this electrical current is distributed to the three outputs of the filter cards. In this way the 3 light dimmers are activated by the control voltages conditioned on frequency and dynamics. The 3 light sources connected to respective filter cards reproduce these frequencies and dynamics as visible light.

The prototype of the converter is fitted with 6 filtercards, all working identically. Each individual filtercard is set to process 6 oscillations doublings in succession between 130,8 Hz and 8371,2 Hz. Each filtercard is connected to 3 light dimmers which produces in total 3×6 light displays=18. These 6 light displays are focused on each of their respective displays. Each set of light displays consists of 3 primary colours red, green and blue, with wavelengths respectively of 720 nm (red), 539 nm (green) and 453 nm (blue). Through an analysis of the whole sound spectrum within a frequency doubling (for example 440 Hz to 880 Hz) it is possible for the light sources, through variable control voltages, to represent the complete visible colour spectrum.

On the basis of this oscillation doubling principle in the converter, any sound frequency will be represented unambiguously in the colour spectrum by means of the converter. In this system it has been possible to make a complete linear conversion between sound and light and because all filters are constructed analoguosly all light shade transisitions are completely even (gradual).

The conversion principle of the converter is founded on the recognition of the natural structure of sound and light and the subsequent connection. This connection means that every frequency will represent a specific colour, and that any sound, including over and under tone spectra, reverbation and acoustic circumstances will also represent a specific colour.

The process together with the apparatus is fully analogue constructed to insure the fastest reaction response to the conversion. Each filter is constructed using state-variable filter technology, which gives the optimal phase response to audio. Unlike tripotientmeters, which quickly lose aligment, there is presently used measured, hand built resistors which display great reliability.

EXAMPLE a.

At the outset: A wavelength of 75 cm corresponding to a pure sinus tone with the frequency 440 Hz. The wavelength is halved to 37,5 cm resulting in that the frequency is doubled to 880 Hz. By carrying out wavelength division 20 times, the wavelength is reduced to 719 nm corresponding to an oscillation of 461.373 kHz. After 5–6 oscillation doubling, approx 20.000 kHz, the frequency is no longer audible to the human ear. The oscillation frequency of 264.373 kHz is visible to the human eye as red light.

The conversion factor from sound to light is dependent on, which frequency/frequencies is used as input, dependent on where the number of frequency doublings, the sound or sounds to be converted, is positioned from the visible spectrum frequency. In this way through the calculation factor. a direct transformation function between sound and light is created.

EXAMPLE b.

As in example a the starting point is a pure sinus tone of 440 Hz, which in musical terminology is equivalent to the note "A". We now halve the wavelength to 37,5 cm=880 Hz. The tone is still A, only an octave higher. If we carry on halving wavelengths 20 times, the final wave would be 719 nm=461.373 kHz equivalent to red light. As already stated, after 5–6 octaves the frequency is out of the audible range of the human ear. We are unable to hear the tone, but we still allow calling it A as we repeat octaves. After having octave doubled 20 times from 440 Hz we arrive at a point where "A" is visible corresponding to the colour red at 719 nm=461.737 kHz. Each frequency/tone has a specific colour.

As the starting point is a pure sinus tone the converted result will be definitively red. The majority of sounds we know, have a more complex wave structure. Therefore the result of the same note "A"/440 Hz still will be red (basic tone), but in addition a variety of overtone spectra will be present, resulting in a number of colours will represent the higher frequencies (overtones) together with the lower frequencies (undertones) depending on which sound source is used.

FIG. 2 illustrates how band-pass filters are arranged in connection to each other. The filters referenced to have a slope, in which the signal is 24 dB below each filter top. This is necessary due to the insulation demands between two individual tones, which are to be registered.

The filters are constructed after the state-variable principle which is illustrated in FIG. 5, whereby it is possible to achieve the necessary filter slope and appropriate phase relationships in the transition frequencies.

FIG. 7 illustrates a print board drawing of the filter as set out in FIG. 2 and FIG. 5.

The system is designed to process a complete octave, in other words 12 halfnotes for each filtercard. It is therefore nessecary, that the center frequency of each note is placed exactly at the resonance top of the related filter and immediately after falls sharply before the next filter. The filters must not have a smaller Q factor than that for avoiding oscillation in the filters. This results in an compromise evaluation in relation to the slope/ringing of the filters and is different depending on which note is involved. All the filters are therefore precisely adjusted with handfiled 1% metal film resistors, both for accuracy in the filterfrequency and the band width, which is referred to as Q.

After that all the filter cards have been adjusted to their respective filterfrequencies, the corresponding mixing levels are (red, green, blue) are adjusted.

Mixing of colours is achieved by aggregating the pure amplitude modulated signals from the 12 filters in 3 different virtual earth summing amps, respectively called red—green and blue sum amps. From each filter a total of 3 resistors are connected to a semi balanced summing bus, respectively, and depending on how the 3 resistors relative Ohm values are set, these will enter the 3 sum amps at a precisely set level.

The 3 sum amps are followed by an A/C convertor, which converts radio signals to DC current from 0–10 VDC. This scale has been chosen because it matches to nearly all existing lighting equipment.

This DC current is sent from the apparatus to an ordinary light system containing triac-controls for incandescent lamps.

If in the first instance, only one frequency doubling is used, 3 lamps will be used, namely red, green and blue. These 3 triacs receive their current from the 3 sum amps.

When the filter card receive a tone (note), for example an A, the filter A will allow the tone to pass, while the other filters will block this frequency. In accordance with the table above the tone A equals red.

Though it was previously mentioned that each filter had 3 resistors connected to the sum bus, in the case of tone A it is only necessary with 1 resistor to the red sum amps.

The signal from the red sum amps will be subsequently be rectified and sent as DC current to the triac, which makes the red lamp to light up.

If alternatively the note of C is sent to the soundcard, the filter C will likewise allow the tone to pass and the other filters will in turn block for this particular tone. The note (tone) C represents the colour yellow, which is a mixture of 50% red and 50% green. In this case the filter signal passes down to the red and green summing bus through 2 resistors, whose mutual related values are 50% and 50%. As previously referred to, the signals end up as DC current, and now both red and green lamps are illuminated, which, when mixed on a white surface or projected through a transparent medium will produce the colour yellow.

FIG. 6 and FIG. 4 shows an input board. FIG. 8 illustrates the print board for the input board. This board consists of a stereo line input and a mono microphone input. These inputs are all electronically balanced in order to avoid outside interference noise and other possible signal problems, when using long cable lengths to and from the apparatus.

The possibility is also present for mixing line and microphone signals together when both switches are activated at the same time.

The actual principal of the input board is that the line input is received in stereo and relayed to the built in stereo mixer, to which the mono microphone signal arrives. This microphone signal is sent to both left and right channels, so that it always appears in the middle of the stereo signal. From there the signal is relayed to a stereo output step, where the line and microphone signals emerge as mixed. This stereo output ends in 2 jack sticks at the back of the apparatus and are used to connect a stereo amplifier with its related speakers. It is not possible to change the level of the line signal, since it is preconditioned that as the input level is placed between −10 to 0 dB.

The microphone input has however a gain-potentiometer at the front. This has a scale from −50 to +10 dB. At this input an 18 volt phantom-voltage is operative, when using a microphone of the condensor type. The phantom-voltage cannot be turned off, but has no consequence for the operation of dynamic microphones and cannot damage them in any way.

From the mixer component the stereo signal is divided into 2 lines. A stereo signal is relayed to the previously mentioned output step, and a mono-mix of left and right is sent from the input board to the limiter board, where one has the possibility of adjusting compression drive and output level. From here these are returned to the input board, where the mono signal is distributed and subdivided to 6 seperate amplifiers, with individual related trimmer controls at the front. Each of these amplifiers exits from the board to their related filter boards, which in the mentioned system are 6 in number.

Limiter Function for the Converter.

FIG. 3 illustrates how the limiter board processes the incoming audio. FIG. 9 illustrates the print board. As it appears from the figure, we are not talking about a real limiter, but about a compression of the audio signals with such a large ratio as it becomes an approximation of a limiter curve. This is necessary in order to adapt dynamic audible sound to the often rather less dynamic light spectrum.

Alternative Embodiments of the Converter.

In addition to the above other embodiments can also be used. For example a version which includes 3 filters per oscillation doubling instead of the 12 which the prototype is equipped with. The bandwidth and slope of the three filters refer directly to the frequency-related position in the light spectrum of the 3 primary colours, see also FIG. 10. This shows the position of the primary colours (red, green and blue) placement in relation to one frequency doubling together with the filter's slope for this prototype using 3 filters per oscillation doubling and directly referring to the visible light spectrum.

In addition a PC-based digital version is very well suited. This model is based on the same basic principles as the analogue model, but can better meet specific demands from users and have a great degree of flexibility in relation to the areas of analysis (frequencies—even those out of the audible spectrum), the possibility of colour-freezing, repetition of frequency changes and colour combinations etc.

A PC version will open up the possibilities of running the converter together with already existing analyzing tools as used in connection with speech teaching.

Future versions will also be able to use an ordinary TV for example, a wide screen projector or a monitor as a display/mixing medium.

For people whose hearing abilities are partially or completely impaired, the conversion is a new method for training language and auditive orientation, amongst other things as an articulation tool. In connection with work amongst the physically and psychologically handicapped the conversion also acts as a concentration and motivation tool.

For the hearing human the conversion is a means for more intense awareness of music, music understanding and a new visual sound dimension in daily life for relaxation, entertainment, immersion or enjoyment.

I claim:

1. In a method for converting sound waves into electromagnetical wave movements comprising light, which sound waves are converted to an electrical signal and are processed in a number of filters, where one filter processes a part of the electrical signal, the size of the part being dependent of the frequency of the sound wave, and where the remaining filters process remaining parts of the electrical signal, distribution among the remaining filters being similarly a function of the frequency of the sound wave, the filters subsequently each being connected to respective colour displays, where the colour display of each filter is a predetermined colour, and where the generating of each single colour display is directly proportional to the part of the signal processed by the corresponding filter, the colour displays being visualized in a colour display means as a single colour or as a mixture of two or more colour displays, where the electrical signal is divided into intervals each being processed by three filters, the improvement comprising that each interval spans a frequency doubling of the original sound wave.

2. A method according to claim 1, wherein for each sound interval the colour displays are generated in different and predetermined sections on the colour display means.

3. A method according to claim 1, wherein position, bandwidth, and slope of the three filters in combination spanning a single interval correspond directly to the frequency-related position in the light spectrum of the three primary colours.

* * * * *